US008075460B2

(12) United States Patent
Parrilla

(10) Patent No.: US 8,075,460 B2
(45) Date of Patent: Dec. 13, 2011

(54) BARBELL HOLDER

(76) Inventor: Marco Parrilla, Lorain, OH (US)

( * ) Notice: Subject to any disclaimer, the term of this patent is extended or adjusted under 35 U.S.C. 154(b) by 0 days.

(21) Appl. No.: 12/978,781

(22) Filed: Dec. 27, 2010

(65) Prior Publication Data

US 2011/0092344 A1 Apr. 21, 2011

Related U.S. Application Data

(62) Division of application No. 12/231,630, filed on Sep. 3, 2008, now Pat. No. 7,874,966.

(51) Int. Cl.
*A63B 21/078* (2006.01)
*A63B 23/00* (2006.01)

(52) U.S. Cl. ..... 482/104; 482/148

(58) Field of Classification Search ..... 482/94, 482/104, 148; 211/85.7, 191, 204, 103, 187, 211/190, 206–207, 60.1; 248/161, 125.1, 407, 411, 309.1; 29/525.01
See application file for complete search history.

(56) References Cited

U.S. PATENT DOCUMENTS

| | | | | |
|---|---|---|---|---|
| 4,904,110 | A * | 2/1990 | Klein | 403/379.3 |
| 5,440,844 | A * | 8/1995 | Chihara et al. | 52/280 |
| 6,257,565 | B1 * | 7/2001 | Houston et al. | 269/249 |
| 7,025,712 | B2 * | 4/2006 | Parrilla | 482/104 |
| 7,635,322 | B2 * | 12/2009 | Parrilla | 482/104 |
| 2002/0016239 | A1 * | 2/2002 | Slawinski et al. | 482/104 |
| 2002/0130099 | A1 * | 9/2002 | Rene et al. | 211/189 |

* cited by examiner

*Primary Examiner* — Fenn Mathew
(74) *Attorney, Agent, or Firm* — Sand & Sebolt

(57) ABSTRACT

A weightlifting barbell holder assembly is especially useful for mounting a weightlifting barbell in a generally horizontal position on a horizontal metal beam, typically an I-beam or U-beam. Preferably, the barbell is at least partially within a horizontal channel defined by the beam when mounted thereon.

20 Claims, 5 Drawing Sheets

BARBELL HOLDER

CROSS REFERENCE TO RELATED APPLICATIONS

This application is a divisional of U.S. patent application Ser. No. 12/231,630, filed Sep. 3, 2008, now U.S. Pat. No. 7,874,966; the disclosure of which is incorporated herein by reference.

BACKGROUND OF THE INVENTION

1. Technical Field

The present invention relates generally to weight lifting equipment. More particularly, the present invention relates to a barbell holder for supporting a barbell when the weights which are mountable on the barbell are removed. Specifically, the invention relates to barbell holder which is mountable on a horizontal beam such as an I-beam.

2. Background Information

It is well known in the field of weight lifting that the associated equipment can take up a great deal of space. Inasmuch as sufficient space is not always available to spread out various components of the weight lifting equipment, there is a general need in the art to minimize the space that such equipment consumes and to provide suitable storage for various components. More particularly, the specific area of lifting free weights typically involves the use of a barbell on which are removably mounted various weights in the form of plates or circular discs which normally provide the vast majority of the weight being lifted. Even when the weights are removed from the barbell, the barbell can take up a reasonably substantial amount of space and brings its own problems when stored in various manners. For instance, placing the barbell on the floor eliminates the ability to use that floor space for other purposes and also may cause an underfoot tripping hazard or the like. In addition, generally vertical storage of the barbell may create dangers inasmuch as the barbell may be inadvertently tipped over. In light of the fact that many barbells are twenty, thirty or forty pounds or more, a substantial danger exists with such vertical storage. Although barbells may be seated on the standard supports which are used during bench pressing or the like, this type of storage also takes up additional space in a manner which may be undesirable at any given time. Thus, there is a need in the art for a more convenient manner of storing such a barbell.

BRIEF SUMMARY OF THE INVENTION

The present invention provides, in combination, a horizontal metal beam having a front, a back, and left and right ends defining therebetween a longitudinal direction; the beam comprising an upwardly extending web and upper and lower flanges rigidly secured to and extending forward from the web to respective terminal front edges so that the web and flanges define therebetween a longitudinally elongated channel rearward of the front edges and the front edges define therebetween a front entrance opening of the channel; and a weightlifting barbell holder assembly comprising: first and second longitudinally spaced barbell holders removably secured to the beam; and first and second seating surfaces respectively on the first and second barbell holders adjacent the channel whereby the seating surfaces are positioned to support a weightlifting barbell adjacent the channel when the barbell is seated on the seating surfaces.

The present invention also provides a method comprising the steps of: securing first and second longitudinally spaced barbell holders on a substantially horizontal metal beam adjacent a channel defined between an upwardly extending web of the beam and upper and lower flanges of the beam which extend forward from the web; and seating a weightlifting barbell on the barbell holders so that the barbell is adjacent the channel.

The present invention further provides a weightlifting barbell holder comprising: a body a seating surface on the body configured to support a weightlifting barbell in a generally horizontal position; and a securing mechanism carried by the body and configured for mounting the body on a horizontal metal beam adjacent a channel defined between an upwardly extending web of the beam and upper and lower flanges of the beam which are rigidly secured to and extend forward from the web.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
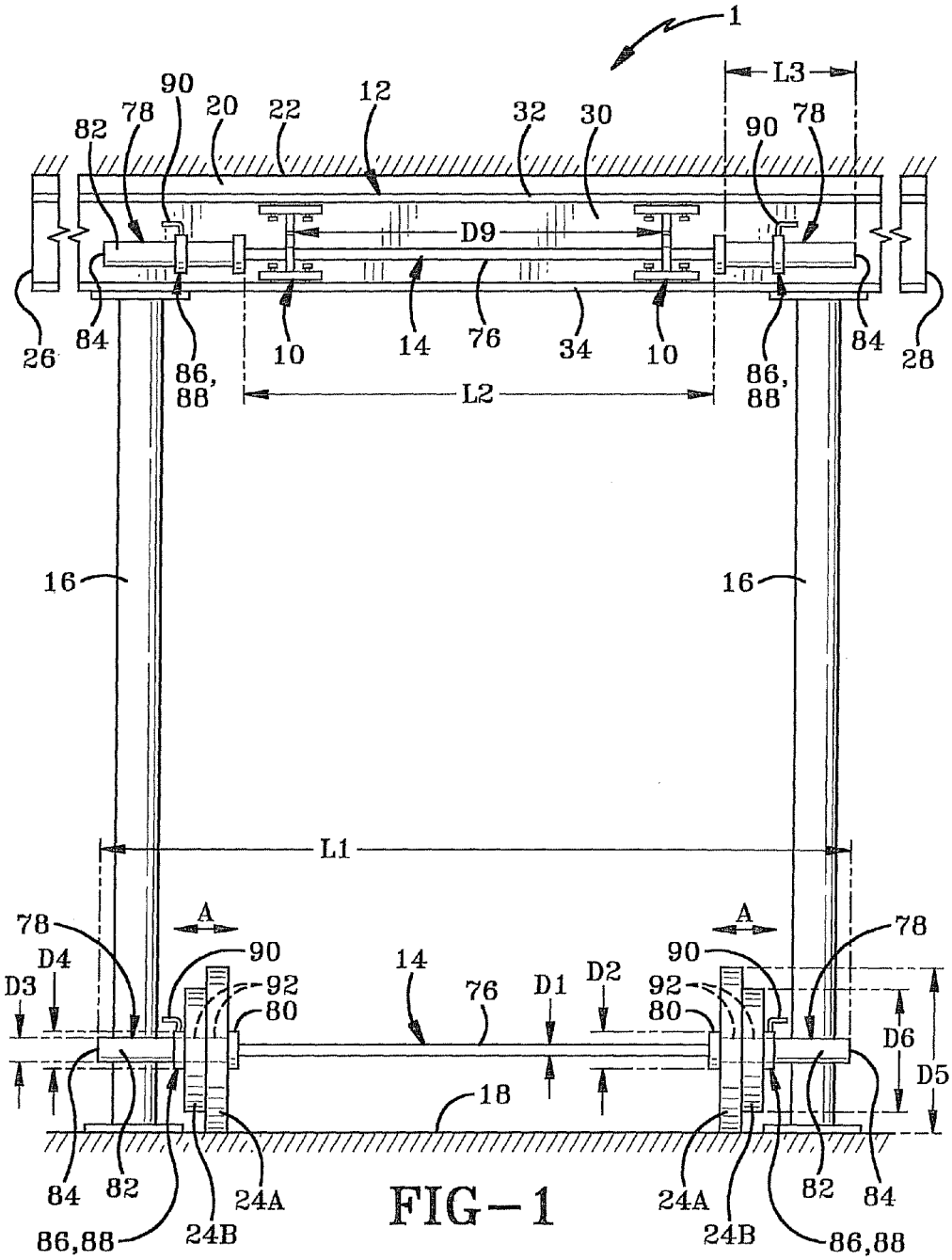
FIG. 1 is a front elevational view of the barbell holder assembly of the present invention mounted on an overhead horizontal beam and supporting a barbell thereon.

The barbell support or holder assembly of the present invention is shown generally at 1 in FIG. 1 and includes a pair of barbell holders 10. Barbell holders 10 are shown in FIG. 1 mounted on an elevated horizontal beam 12 and supporting a barbell 14. Barbell holders 10 are shown in greater detail in FIGS. 2-4.

Referring to FIG. 1, it is well known that horizontal beams such as I-beams or U-beams are used in certain types of building or housing construction to provide much of the structural strength of a house or other type of building. Sometimes these horizontal beams are exposed as is often the case in the construction of a basement of a house or the like. FIG. 1 generally illustrates this type of construction. In this type of construction, horizontal beams are typically supported by vertical walls, columns or other vertical supports which are represented in FIG. 1 by vertical support poles 16. Poles 16 are laterally spaced from one another with their bottom ends seated on or embedded in floor 18 which is most commonly formed of concrete. Horizontal beam 12 is seated atop the upper ends of poles 16. Poles 16 and beam 12 are typically formed of steel or another metal whereby each of poles 16, beam 12 and floor 18 provide a large degree of compressive strength in order to provide a good structural foundation for the building. Beam 12 thus supports various overhead structural components 20 such as the joists which support the floor of the level of the structure above the basement. The basement room may also include a finished ceiling 22 or the like. FIG. 1 also shows another barbell 14 on which several weights 24 are removably mounted, including larger diameter weights 24A and smaller diameter weights 24B.

Figure 6:
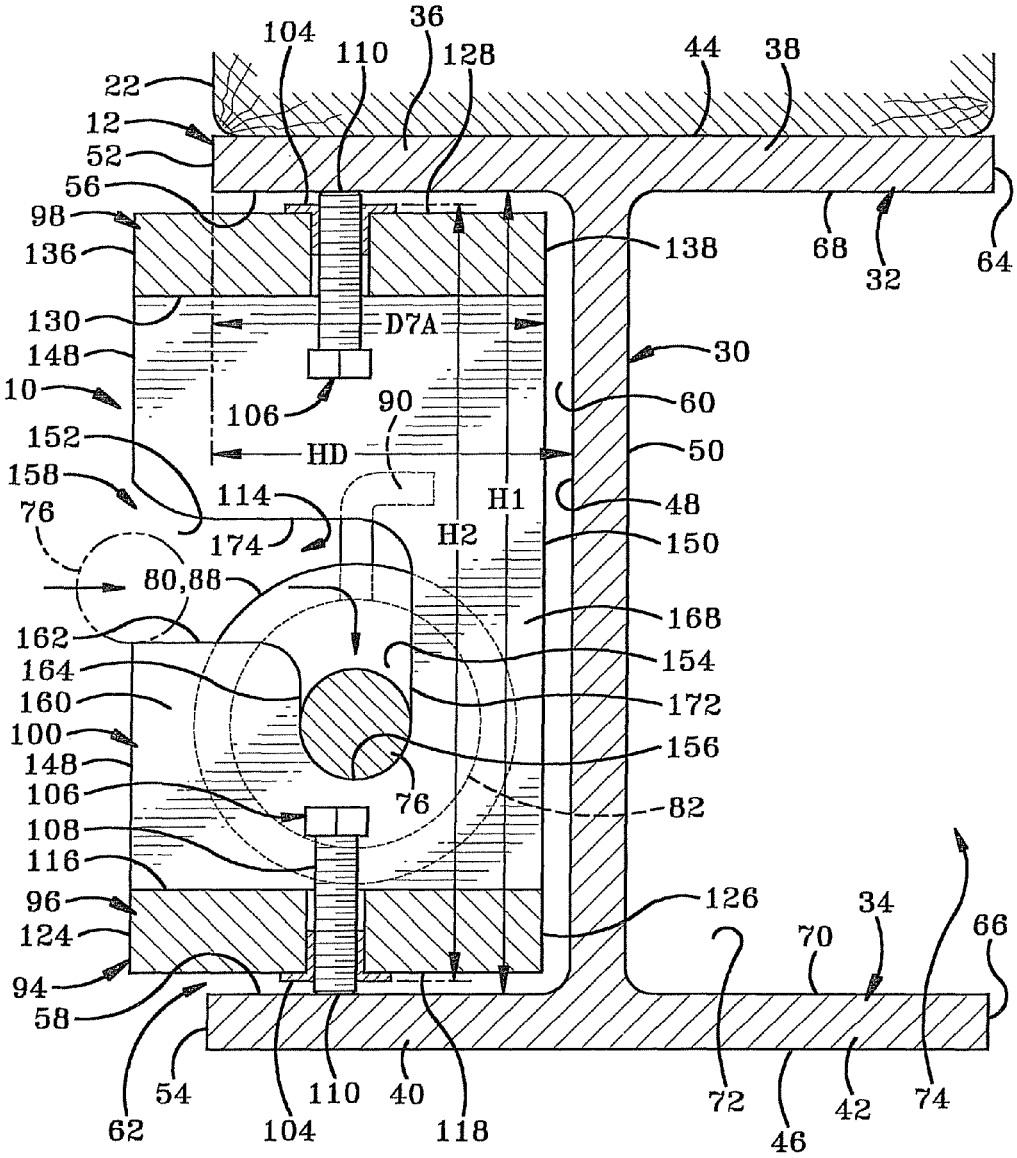
FIG. 6 is a sectional view taken on line 6-6 of FIG. 5 showing the seating of the barbell on the seating surface of the barbell holder.

Referring now to FIGS. 1 and 6, horizontal beam 12 is described in greater detail. Horizontal beam 12 in the exemplary embodiment is an I-beam having left and right ends 26 and 28 defining therebetween a longitudinal direction of the beam. I-beam 12 includes a longitudinally elongated central upwardly extending and typically vertical plate or web 30 with upper and lower crossbars 32 and 34 respectively rigidly secured to the upper and lower ends of web 30. Each of crossbars 32 and 34 is in the form of a longitudinally elongated and horizontal plate and thus extends perpendicular to web 30. Upper crossbar 32 includes a front upper flange 36 which extends forward from web 30 and a rear upper flange 38 which extends rearwardly from web 30. Likewise, lower crossbar 34 includes front and rear lower flanges 40 and 42 which respectively extend forward and rearwardly from the bottom end of web 30. Upper crossbar 32 has a substantially horizontal top upwardly facing surface 44 which serves as the top surface of flanges 36 and 38 and beam 12. Lower crossbar 34 has a substantially horizontal bottom downwardly facing surface 46 which serves as the bottom of flanges 40 and 42 and of beam 12. Web 30 has a vertical front or forward facing surface 48 and a rear or rearward facing vertical surface 50 which is parallel to front surface 48. Upper and lower front flanges 36 and 40 extend forward respectively to front terminal edges 52 and 54 which in the exemplary embodiment lie along a common longitudinally extending vertical plane. Front upper flange 36 has a lower downwardly facing substantially horizontal surface which extends rearwardly from front edge 52 to adjacent front surface 48 of web 30. Likewise, lower front flange 40 has an upper or upwardly facing surface 58 which extends rearwardly from terminal edge 54 to adjacent front surface 48 of web 30. Surfaces 48, 56 and 58 define therebetween a horizontally elongated space or channel 60 having a forward facing entrance opening 62 defined between terminal edges 52 and 54. Channel 60 is substantially rectangular in cross section. Surfaces 56 and 58 define therebetween a vertical distance or height H1 which is the height of channel 60. Front vertical surface 48 and front terminal ends 52, 54 define therebetween a horizontal distance HD which is the horizontal depth of channel 60 as measured from its front to its back. Upper and lower rear flanges 38 and 42 have respective rear terminal edges 64 and 66. Rear upper flange 38 has a horizontal lower downwardly facing surface 68 extending forward from terminal edge 64 to adjacent rear surface 50. Likewise, lower rear flange 42 has a horizontal upper and upwardly facing surface 70 which extends forward from terminal edge 66 to adjacent rear surface 50 of web 30. Surfaces 50, 68 and 70 define therewithin a channel 72 which is a substantial mirror image of channel 60 and has a rear entrance opening 74. While barbell holders 10 are shown used with a horizontal beam in the form of I-beam 12, it may also be used, for example, with a U-beam which would be substantially the same as I-beam 12 without its upper and lower rear flanges 38 and 42.

Referring to in FIG. 1, weight lifting barbell 14 is described in greater detail. While some barbells are formed primarily of a single bar having a constant diameter from end to end, barbell 14 includes a central bar or handle 76 which is straight and has a constant diameter D1 typically on the order of about one inch and a pair of opposed weight mounting end portions 78 secured to the opposed ends of handle 76. Each end portion 78 includes an inner collar or stop segment 80 and a weight bearing segment 82 which extends outwardly from stop segment 80 to a respective terminal end 84. End portions 78 may be fixedly secured to the ends of handle 76 or rotatably mounted thereon about the longitudinal axis of handle 76. Stop segment 80 thus steps radially outwardly from handle 76 and has a diameter D2 which is larger than diameter D1. Weight bearing segment 82 steps inwardly from stop segment 80 opposite handle 76 and has a diameter D3 which is less than diameter D2 and greater than diameter D1. The opposed ends 84 of barbell 14 define therebetween a length L1 thereof which is less than that of horizontal beam 12. Length L1 typically ranges from about 44 inches to 86 inches. Handle 76 has a length L2 defined between inner collars 80 which typically falls within the range of about 30 to 60 inches. Weight bearing segment 82 has a length L3 defined between inner collar 80 and a respective end 84 which is typically from about 6 to 18 inches. Barbell 14 optionally includes outer securing collars 86 which in one embodiment include a generally circular disc 88 defining a threaded hole for threadably receiving a locking screw 90 which may be rotated in opposite directions to releasably secure disc 88 on weight bearing segment 82 on the opposite side of weights 24 from stop segment 80 in order to secure weights 24 on segment 82. Disc 88 has a diameter D4 which is larger than diameter D1 and D3 and typically is about the same as diameter D2. Diameters D1, D2, D3 and D4 are less than height H1 (FIG. 6) of channel 60 and typically also less than horizontal depth HD of channel 60.

With continued reference to FIG. 1, weights 24 are most typically formed of substantially flat plates which are circular or generally circular. The term generally circular for the present purposes includes an outer perimeter shape which is typically a regular polygon such as a hexagon, octagon, decagon or the like. The use of regular polygon shaped plates 24 provide for a flat on the outer perimeter of the plate which prevents the weight from rolling when seated on the outer perimeter in the vertical position shown in FIG. 1. Each weight 24 defines a central mounting through hole 92 which is a diameter which is sufficiently larger than diameter D3 to allow the weight 24 to slide on and off of segment 82 but smaller than diameter D2 and D4 whereby inner collar or stop segment 80 provides a stop to the inward movement of weights 24 and outer collar 88 provides a stop to the outward movement of weights 24 when collar 86 is secured to segment 82. When locking screw 90 is loosened, collar 86 is slideable on and off of segment 82, as are weights 24 (arrows A). Weight 24A has an outer diameter D5 and weight 24B has an outer diameter D6 which is less than diameter D5. Each of diameters D5 and D6 is greater than each of diameters D1-D4. Weights 24A and 24B illustrate in part that various weights may have different diameters. For example, Olympic plates which weigh 10 kg or more have a diameter of about 45 cm, which is about 17.7 inches. Olympic plates which are less than 10 kg typically have a smaller diameter. In any case, diameter D5 and D6 of weights 24 is normally greater than height H1 of channel 60 and is almost invariably larger than horizontal depth HD of channel 60. Thus, weights 24 simply cannot fit within channel 60 with horizontal beam 12. More particularly, although an edge of weight 24 might be inserted into channel 60 when the weight 24 is positioned vertically and a greater portion thereof may be inserted when positioned horizontally, it is generally only this outer edge that might fit into channel 60 if at all. The typical U-beam or I-beam with which holders 10 are used simply do not define a channel 60 which is large enough to receive one of weights 24 for the present purposes of mounting barbell 14 with weights thereon within or closely adjacent channel 60. Thus, for instance, holes 92 formed in weights 24 could not normally be positioned within channel 60, especially when plates 24 are positioned vertically as shown in FIG. 1. Thus, barbell holders 10 are configured for the mounting of barbell 14 alone within channel 60, and thus when weights 24 are not mounted thereon.

Figure 2:
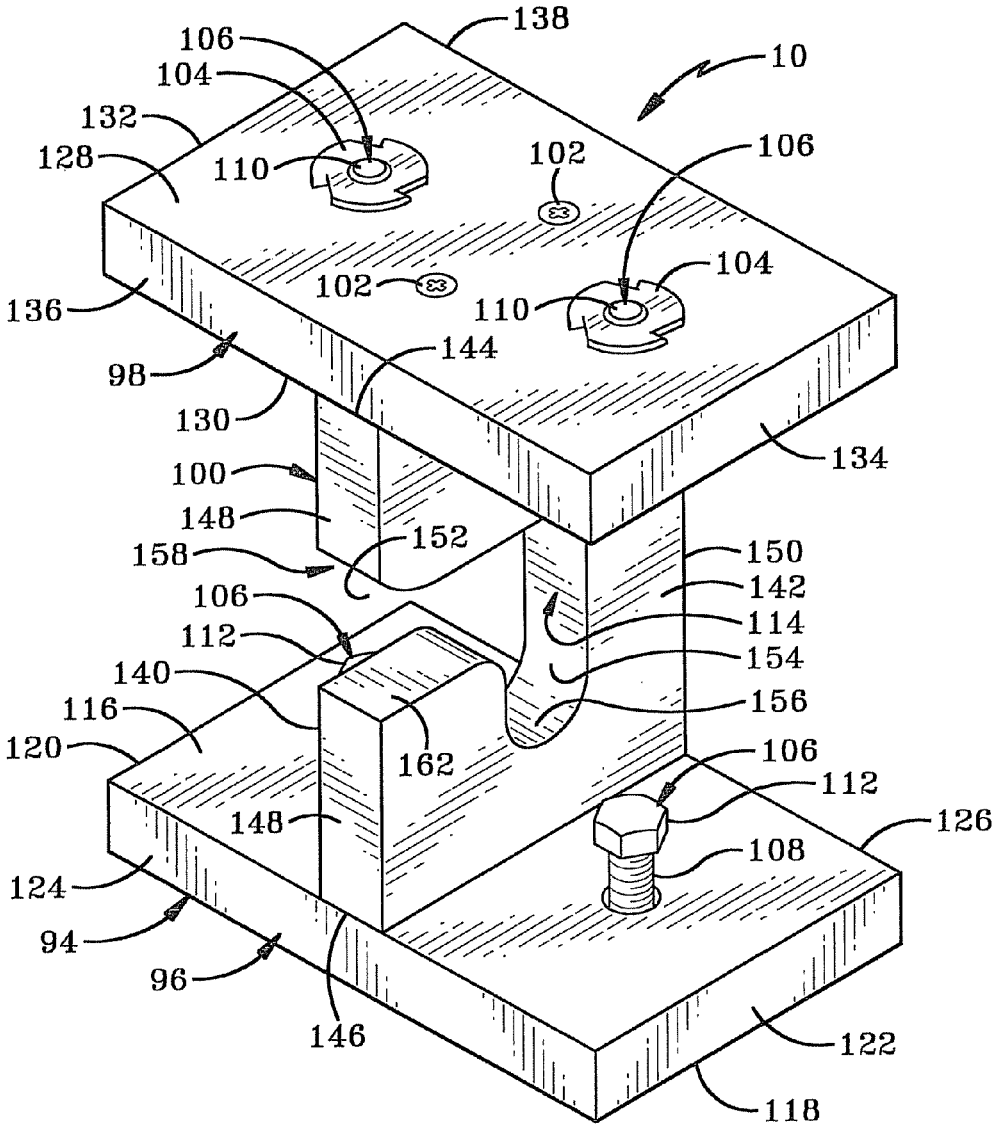
FIG. 2 is an enlarged perspective view of one of the barbell holders of the present invention.
Figure 4:
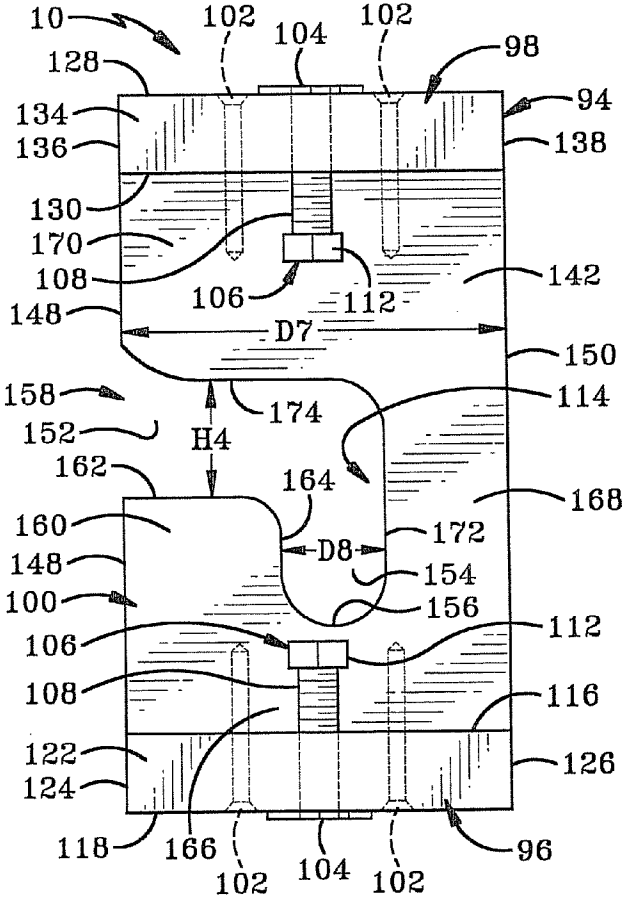
FIG. 4 is a side elevational view of the barbell holder.
Figure 3:
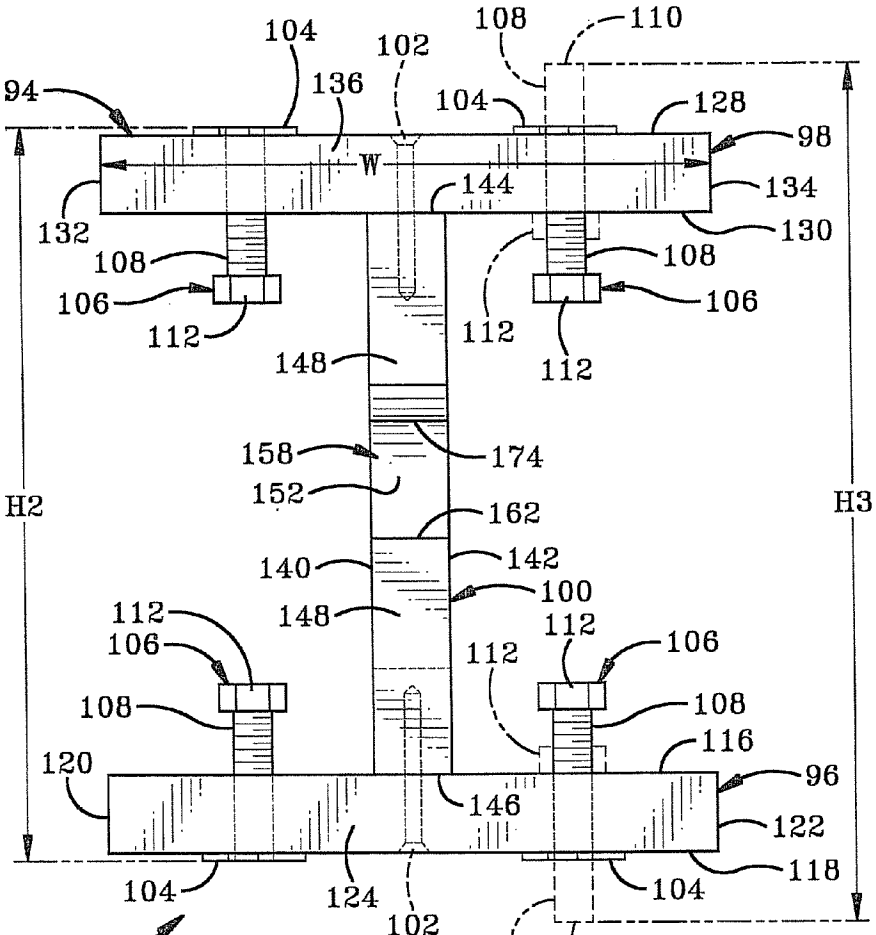
FIG. 3 is a front elevational view of the barbell holder.

Referring now to FIGS. 2-4, holder 10 is described in greater detail. In the exemplary embodiment, holder 10 includes a rigid I-shaped or H-shaped body or block 94 which includes a rectangular horizontal base wall 96, a rectangular horizontal cap wall 98 and an upwardly extending and typically vertical central wall 100 which is rigidly secured to and extends between base wall 96 and cap wall 98. In the exemplary embodiment, base wall 96 and cap wall 98 are secured respectively to the bottom and top of vertical wall 100 respectively by a pair of screws 102. Other fasteners or fastening mechanisms may be used to secure walls 96 and 98 to wall 100. In the exemplary embodiment, walls 96, 98 and 100 are formed of wood. However, said walls may be formed of other rigid materials such as metal or plastic. Block 94 might for example be formed as an integral one piece member formed of plastic such as by molding or other suitable methods. A pair of internally threaded members 104 is secured to each of base wall 96 and cap wall 98 for receiving therethrough and threadedly engaging respective externally threaded members 106 whereby holder 10 is vertically expandable and retractable. More particularly, each threaded member 106 is typically in the form of a bolt including an externally threaded shaft 108 having a beam engaging terminal end or tip 110. The bolt further includes an enlarged head 112 secured to the opposite end of threaded shaft 108 where head 112 is typically hexagonal or another shape having a flat so as to be engaged by a wrench to facilitate the threading and unthreading rotation of member 106. Threaded members 104 and 106 provide a securing mechanism for removably securing holder 10 on beam 12.

In the exemplary embodiment, base wall 96 and cap wall 98 are substantially rectangular. Vertical wall 100 is also substantially rectangular and defines an L-shaped notch 114. Base wall 96 has flat rectangular top and bottom surfaces 116 and 118, left and right sides or edges 120 and 122, and front and rear sides or edges 124 and 126. Likewise, cap wall 98 has rectangular flat top and bottom surfaces 128 and 130, left and right sides or edges 132 and 134, and front and back sides or edges 136 and 138. Vertical wall 100 has flat generally U-shaped left and right vertical surfaces 140 and 142, top and bottom or edges 144 and 146, and front and back sides or edges 148 and 150. In the exemplary embodiment, front edges 124, 136 and 148 are substantially coplanar and define the front of holder 10. Likewise, back surfaces 126, 138 and 150 are substantially coplanar and define the back of holder 10. Left edges 120 and 132 are substantially coplanar and vertically aligned whereby said edges define the left side of holder 10. Likewise, edges 122 and 134 are substantially coplanar and vertically aligned whereby they define the right side of holder 10. The front and back surfaces of holder 10 define therebetween a horizontal distance or depth D7 (FIG. 4). Although depth D7 in the exemplary embodiment is greater than horizontal distance HD (FIG. 6), this may vary somewhat and the two distances are typically similar. Distance D7 may be equal to or less than distance HD. Distance D7 should be sufficient in order to provide for notch 114 in order to receive barbell 14 therein so that barbell 14 cannot accidentally be unseated within notch 114. In the exemplary embodiment, depth D7 is approximately 3¾ inches although this may vary and is typically within the range of about 2 to 6 inches, and no usually more than 4 or 5 inches. As a general rule, it is preferred to keep depth D7 to as small a dimension as possible while providing sufficient strength and other characteristics to allow holder 10 to perform its purpose. The left and right sides of holder 10 define therebetween a width W (FIG. 3) which in the exemplary embodiment is about 6 inches while the horizontal distance between the centers of threaded shafts 108 is about 3 inches. Once again, width W may vary and is preferably as small as possible while allowing holder 10 to function for its purpose. Typically, width W is within a range of about 2 or 3 inches to 7 or 8 inches and preferably is no more than about 4, 5 or 6 inches in order to minimize the material used. Thus, width W is far less than length L1 of barbell 14 and typically less than the length of end portions 78 or length L3 of segments 82.

As previously noted and with reference to FIG. 3, holder 10 is vertically expandable and retractable. FIG. 3 illustrates this by showing the minimum height H2 and maximum height H3 of holder 10. More particularly, the bottom of the lower internally threaded member 104 and the top of the upper internally threaded member 104 define therebetween the minimum height H2 of holder 10. With the slight modification of countersinking the internally threaded members 104, or forming threaded holes directly in base wall 96 and cap wall 98, lower and upper surfaces 118 and 128 would define therebetween the minimum height of holder 10. Thus, minimum height H2 occurs when externally threaded members 106 are rotated to adjust their height so that the tip 110 of each upper members 106 is no higher than the top surface of block 94 and each bottom threaded members 106 is rotated so that its tip 110 is positioned no lower than the bottom surface of block 94. This is illustrated by the threaded members 106 shown in solid lines in FIG. 3. FIG. 3 further shows phantom lines on the upper and lower right members 106 the fully extended position of threaded members 106 and thus the fully expanded position of holder 10 whereby tips 110 of the respective members 106 define therebetween the maximum height H3. In the exemplary embodiment, height H2 is about 7 inches and height H3 is about 8.5 inches, thus providing a vertical expansion differential of about 1.5 inches. However, this may vary since the amount of vertical expansion required for the mounting of holder 10 may be relatively minimal as described later with reference to FIG. 6. Height H2 is less than height H1 (FIG. 6) while height H3 is greater than height H1. In the exemplary embodiment, holder 10 is configured for use with a U-beam or I-beam such as beam 12 which has a height of about 8 inches whereby height H1 is typically on the order of about 7 to 7.5 inches. It will be appreciated that the ability to expand holder 10 allows it to be used within spaces analogous to spaces 60 and having a height which is within the range of greater than height H2 and less than height H3. It will also be appreciated that holder 10 may be made larger or smaller as needed to fit respectively within channels of larger or smaller U-beams or I-beams.

Referring now to FIG. 4, notch 114 includes a front rearwardly extending and generally horizontal portion 152 and a rear portion 154 which extends downwardly generally vertically from the rear of the front portion 152 to a concavely curved upwardly facing seating surface 156 at the bottom of rear portion 154. Notch 114 has a front entrance opening 158 at the front of portion 152 which communicates with front edge 148. Notch 114 thus extends rearwardly from front edge 148 and then downwardly to seating surface 156. Rear portion 154 and front edge 148 define therebetween a retaining wall 160 which projects upwardly to a top surface 162 which is higher than surface 156. Top surface 162 extends rearwardly and faces upwardly and transitions to a stop surface 164 which extends downwardly and faces rearwardly to bound the front of rear portion 154 of notch 114. Vertical wall 100 includes a bottom wall segment 166 having a front portion from which retaining wall 160 extends upwardly. Vertical wall 100 further includes a back wall segment 168 which extends upwardly from the rear of bottom wall segment 166, and a top wall segment 170 which extends forward from the top of back wall segment 168. Back wall segment 168 has a front surface 172 which extends upwardly substantially vertically and faces forward. Surfaces 164 and 172 define therebetween a distance or depth D8 of rear portion 154 which is typically in the range of about 1 to 1.5 inches although it may be larger. Preferably, depth D8 is slightly larger than 1 inch, for example 1 1/16 or 1 1/8 inches in order to accommodate barbell 14. More particularly, depth D8 is typically slightly larger than diameter D1 of handle 76 of barbell 14. Top surface 174 and bottom surface 162 define therebetween a vertical height H4 of front portion 152 which is typically substantially the same as horizontal depth D8 and thus allows for handle 76 to be inserted therethrough.

The operation of holders 10 is now described with reference to FIGS. 1, 5 and 6. One of holders 10 is inserted rearwardly into channel 60 so that tips 110 of threaded members 106 are disposed rearwardly of front edges 52 and 54 and so that the back 126, 138, 150 of holder 10 is adjacent front surface 48 of web 30, the front 124, 136, 148 of holder 10 is adjacent front edges 52 and 54, the bottom of threaded member 104 and bottom surface 118 of base wall 196 are adjacent and possibly spaced upwardly a short distance from upper surface 58 of front lower flange 40, and the top of the upper threaded members 104 and top surface 128 of cap wall 98 is adjacent and typically spaced downwardly a short distance from bottom surface 56 of upper front flange 46 of horizontal beam 12. Preferably, at least a portion of notch 114 is disposed within channel 60 when holder 10 is inserted therein. Typically, surface 172 of back wall segment 168 is disposed within channel 60 along with the rearmost portion of notch 114 which is defined by surface 172. In the exemplary embodiment, back wall segment 168 in its entirety and lower rear portion 154 of notch 114 in its entirety are disposed within channel 60 along with stop surface 164 and about half of front upper portion 152 of notch 114. FIG. 6 shows that the back of holder 10 is spaced forward a short distance from front 48 of web 30. However, the back of holder 10 may be inserted to abut surface 48. In the exemplary embodiment, well over 50% of the horizontal depth of holder 10 is inserted into channel 60 and thus rearward of front edges 52 and 54. Depending on the specific configuration of channel 60 and holder 10, holder 10 may be in its entirety insertable to channel 60. For example, FIG. 6 illustrates an alternate horizontal depth D7A of an altered holder 10 having a front surface illustrated by the vertical dot dash line whereby depth D7A is less than depth HD. Thus, typically 50% to 100% of holder 10 is inserted into channel 60 and it is common for 60%, 70%, 80% or 90% or greater of the horizontal distance of holder 10 to be inserted into channel 60.

Figure 5:
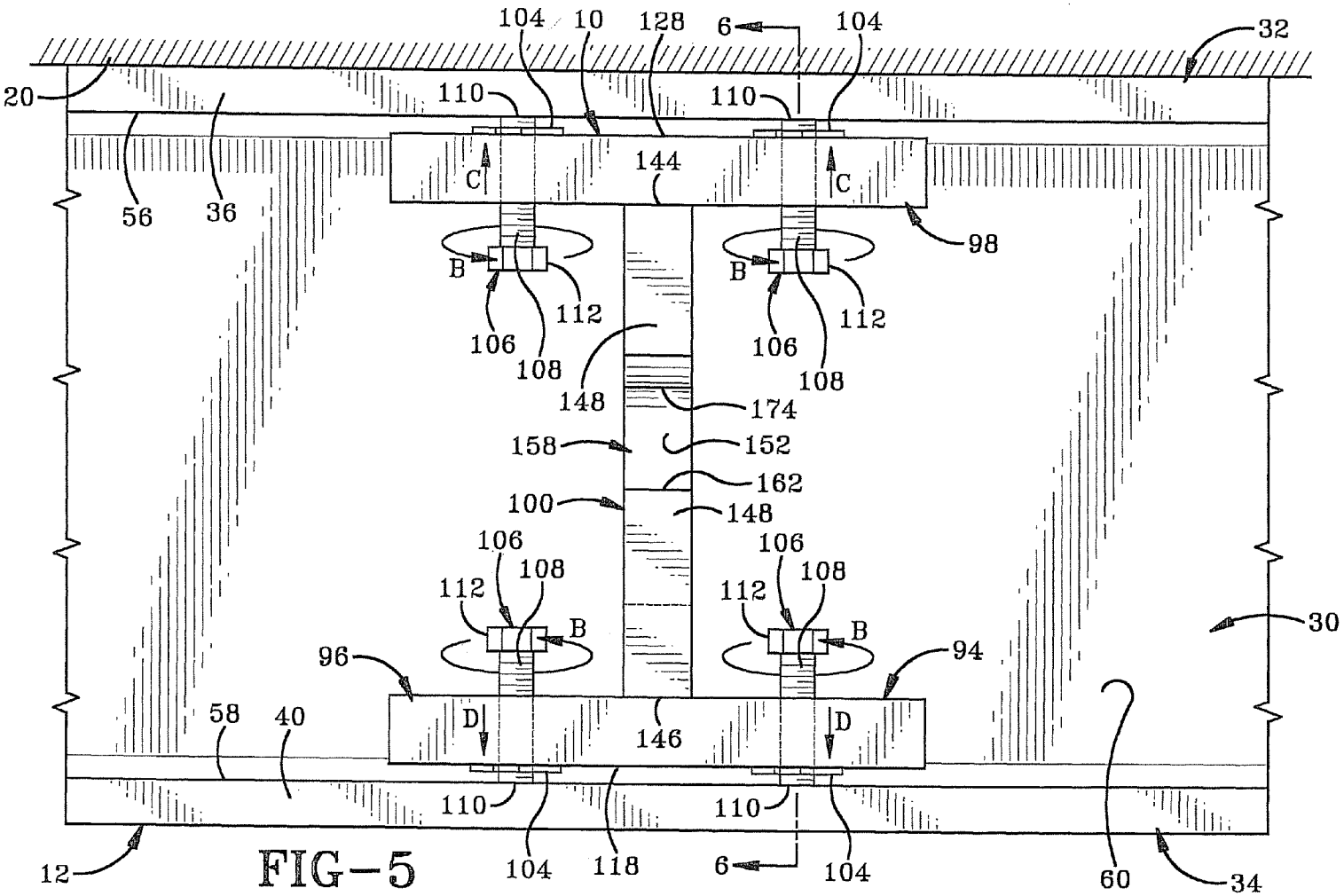
FIG. 5 is an enlarged front elevational view of the barbell holder being mounted on the horizontal beam.

Thus, holder 10 is inserted into channel 60 so that members 106 are rotated as indicated at arrows B in FIG. 5 whereby the threaded engagement between the respective shafts 108 and internally threaded members 104 tightens threaded members 106 so that the upper two members 106 move upwardly (arrows C) and the lower two threaded members 106 move downwardly (arrows D). Thus, the upward movement of threaded members 106 brings the respective tips 110 into a securing engagement with lower surface 56 of front upper flange 36 while the downward movement of the lower threaded members 106 brings their respective tips 110 into securing engagement with upper surface 58 of lower flange 40. The upward movement of the upper two threaded members 106, the downward movement of the lower two threaded members 106, or the combination thereof provides for vertical expansion of holder 10 whereby it is wedged in between flanges 36 and 40 in a secure manner with tips 110 of the upper threaded members 106 providing an upward force against lower surface 56 and the tips 110 of the lower threaded members 106 providing a downward force on upper surface 58. Thus, holder 10 is inserted into channel 60 and subsequently vertically expanded to increase its total height from a first height which is at least equal to height H2 to height H1 in order to secure holder 10 in place on horizontal beam 12. Although threaded members 106 could be threaded into threaded holes formed in a structure such as the flanges of I-beam 12, holder 10 is configured so that tips 110 engage the I-beam flanges without a threaded engagement therebetween. Thus, no threaded holes need be formed in I-beam 12 for mounting holder 10 thereon.

Once one of holders 10 is securely mounted on horizontal beam 12, the other of holders 10 is inserted into channel 60 and vertically expanded in the same manner in order to secure it to horizontal beam 12. More particularly, as illustrated in FIG. 1, holders 10 are inserted and secured at positions which are laterally or horizontally spaced from one another left to right along beam 12. Thus, the right side of the left holder 10 faces the left side of the right holder 10 shown in FIG. 1. The respective vertical walls of the two spaced holders 10 and thus the respective seating surfaces thereof define therebetween a distance D9 when mounted on horizontal beam 12. Distance D9 is less than at length L1 of barbell 14 and typically less than length L2 of handle 76. Thus, distance D9 is typically in the range of about 30 to 60 inches although it may be as little as 18 or 24 inches with respect to barbells of a certain length.

As previously discussed above, when holders 10 are mounted on I-beam 12, a substantial portion of each holder 10 is within channel 60. It is also noted that in the exemplary embodiment, no portion of holder 10 is disposed lower than the top or bottom surfaces 58 and 46 of lower flange 40. Likewise, no portion of holder 10 in the exemplary embodiment is disposed higher than the upper and lower surfaces 44 and 56 of upper flange 36. Additionally, no portion of holder 10 in the exemplary embodiment is positioned rearward of front surface 48 of web 30. Once the pair of laterally spaced holders 10 is secured to horizontal beam 12 within channel 60, holder assembly 1 is ready to receive barbell 114 in order to provide convenient storage of barbell L14 in an elevated position within channel 60. More particularly, barbell 14 is lifted and positioned generally parallel to horizontal beam 12 so that handle 76 may be moved rearwardly into notch 114. More particularly, handle 76 moves rearwardly through front entrance opening 158 into portion 152 and then downwardly from portion 152 into portion 154 of notch 114, as indicated by the arrows in FIG. 6. The bottom of handle 76 is seated atop the respective seating surfaces 156 of each holder 10 so that barbell L14 is supported on horizontal beam 12 via holders 10. The weight of barbell 14 is thus transferred to lower flange 40 primarily and typically entirely via tips 110 of threaded members 106. Stop surfaces 164 of the respective holders 10 prevent barbell 14 from moving forward and thus retaining wall 160 retains barbell 14 within notches 114 so that it cannot come out of notches 114 without an upward and forward force applied to barbell 14. Barbell 14 is thus conveniently stored in an elevated position on holders 10 so that it does not take up floor space or present a falling hazard which may occur from vertical storage as discussed in the Background section of the present application. In addition, the storage of barbell 14 within channel 60 utilizes space which is typically not used for other purposes. Preferably, at least a portion of barbell 14 is disposed within channel 60 and more preferably barbell 14 is entirely disposed within channel 60, and thus rearward of front edges 52 and 54.

Barbell 14 specifically represents an Olympic barbell or power lifting barbell which includes the enlarged outer end portions 78 and in which the handle 76 is straight. However, barbell 14 is also intended to illustrate various other types of weight lifting barbells including other types of standard and Olympic barbells. The standard barbells utilize a bar having a cross sectional dimension which is constant from end to end and thus does not include the weight bearing segments 82 although it may utilize inner and outer collars to secure the weights adjacent the ends of the barbell. Whether the barbell is of a standard configuration or an Olympic configuration, the handle may have configurations which are not straight. For instance, one of the commonly used barbells is known as the EZ curl bar which includes a pair of zigzag grips which allows the weight lifters' wrists and forearms to take a more neutral position. In addition, barbell 14 is intended to represent the cambered squat barbell as well as the flat "U" barbell which are commonly known in the art. Each of these barbells may be mounted on barbell holders 10 in the same fashion as described above.

Another type of barbell which is commonly known in the field of weight lifting is known as the diamond barbell or trap barbell which typically includes a diamond shaped central section from which the outer ends of the barbells extend in opposite directions along the length of the barbell and to which a pair of grips are secured perpendicular to the length of the barbell so that the weight lifter can stand within the opening formed by the diamond and grasp the perpendicular grips during lifting. In some scenarios, holders 10 may be suitable for supporting such a trap barbell although the dimensions of the diamond shaped central portion would prevent said central portion from being entirely received within channel 60 of horizontal beam 12. In order for holders 10 to be appropriately configured for use with a trap barbell, they would have to extend forward of channel 60 a sufficient distance so that portions of the barbell could be received within notches 114 which would be positioned forward of channel 60. In addition, the seating of the trap barbell on such a modified barbell holder would typically need additional space above the horizontal beam in order to accommodate portions of the diamond shaped central section of the barbell. Thus, while barbell holders 10 or a modified version thereof may be suitable for supporting a trap barbell under certain circumstances, barbell holder assembly 1 is typically intended for use with the other barbells noted above.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A method of securing a barbell comprising the steps of:

providing first and second barbell holders each having a securing mechanism and a body defining a seating surface;

securing with the securing mechanisms the barbell holders on a substantially horizontal metal beam so that the barbell holders are longitudinally spaced from one another and adjacent a channel defined between an upwardly extending web of the beam and upper and lower flanges of the beam which extend forward from the web and so that the beam and secured barbell holders together form a barbell holder assembly; and seating a weightlifting barbell on the seating surfaces of the barbell holders of the assembly so that the barbell is adjacent the channel;

wherein the web has a front surface; and the step of securing comprises the step of securing the barbell holders on the beam so that no portion of the barbell holders extends rearwardly of the front surface of the web.

2. A method of securing a barbell comprising the steps of:

providing first and second barbell holders each having a securing, mechanism and a body defining a seating surface;

securing with the securing mechanisms the barbell holders on a substantially horizontal metal beam so that the barbell holders are longitudinally spaced from one another and adjacent a channel defined between an upwardly extending web of the beam and upper and lower flanges of the beam which extend forward from the web and so that the beam and secured barbell holders together form a barbell holder assembly; and seating a weightlifting barbell on the seating surfaces of the barbell holders of the assembly so that the barbell is adjacent the channel;

wherein the step of seating comprises the step of seating the barbell on the seating surfaces of the barbell holders so that the barbell is higher than the lower flange.

3. A method of securing a barbell comprising the steps of:

providing first and second barbell holders each having a securing mechanism and a body defining a seating surface;

securing with the securing mechanisms the barbell holders on a substantially horizontal metal beam so that the barbell holders are longitudinally spaced from one another and adjacent a channel defined between an upwardly extending web of the beam and upper and lower flanges of the beam which extend forward from the web and so that the beam and secured barbell holders together form a barbell holder assembly; and seating a weightlifting barbell on the seating surfaces of the barbell holders of the assembly so that the barbell is adjacent the channel;

wherein the step of seating comprises the step of seating the barbell on the seating surfaces of the barbell holders so that the barbell is at least partially within the channel.

4. The method of claim 3 wherein the step of seating comprises the step of seating the barbell on the seating surfaces of the barbell holders so that the barbell is entirely within the channel.

5. The method of claim 3 further comprising the step of inserting the barbell rearwardly into first and second notches formed respectively in first and second walls of the respective barbell holders; and lowering the barbell within the first and second notches to seat the barbell on the seating surfaces which respectively bound the first and second notches whereby the barbell is at least partially within the channel.

6. A method of securing a barbell comprising the steps of:

providing first and second barbell holders each having a securing mechanism and a body defining a seating surface;

securing with the securing mechanisms the barbell holders on a substantially horizontal metal beam so that the barbell holders are longitudinally spaced from one another and adjacent a channel defined between an upwardly extending web of the beam and upper and lower flanges of the beam which extend forward from the web and so that the beam and secured barbell holders together form a barbell holder assembly; and seating a weightlifting barbell on the seating surfaces of the barbell holders of the assembly so that the barbell is adjacent the channel;

wherein the step of securing comprises the step of securing each barbell holder so that a top of each barbell holder is within the channel adjacent the upper flange and a bottom of each barbell holder is within the channel adjacent the lower flange.

7. The method of claim 6 wherein the step of securing comprises the step of securing each barbell holder so that a back of each barbell holder extends within the channel adjacent the web from adjacent the upper flange to adjacent the lower flange.

8. A method of securing a barbell comprising the steps of:

providing first and second barbell holders each having a securing mechanism and a body defining a seating surface;

securing with the securing mechanisms the barbell holders on a substantially horizontal metal beam so that the barbell holders are longitudinally spaced from one another and adjacent a channel defined between an upwardly extending web of the beam and upper and lower flanges of the beam which extend forward from the web and so that the beam and secured barbell holders together form a barbell holder assembly;

seating a weightlifting barbell on the seating surfaces of the barbell holders of the assembly so that the barbell is adjacent the channel; and mounting first and second securing collars removably on the barbell respectively adjacent opposed ends thereof; and wherein the step of seating comprises the step of positioning the securing collars at least partially within the channel.

9. A method of securing a barbell comprising the steps of:

providing first and second barbell holders each having a securing mechanism and a body defining a seating surface; wherein the body is a rigid body which is I-shaped as viewed from the front and which comprises a horizontal base wall, a horizontal cap wall and an upwardly extending central wall which is rigidly secured to and extends between the base wall and cap wall;

securing with the securing mechanisms the barbell holders on a substantially horizontal metal beam so that the barbell holders are longitudinally spaced from one another and adjacent a channel defined between an upwardly extending web of the beam and upper and lower flanges of the beam which extend forward from the web and so that the beam and secured barbell holders together form a barbell holder assembly; and seating a weightlifting barbell on the seating surfaces of the barbell holders of the assembly so that the barbell is adjacent the channel.

10. A method of securing a barbell comprising the steps of:

providing first and second barbell holders each having a securing mechanism and a body defining a seating surface;

securing with the securing mechanisms the barbell holders on a substantially horizontal metal beam so that the barbell holders are longitudinally spaced from one another and adjacent a channel defined between an upwardly extending web of the beam and upper and lower flanges of the beam which extend forward from the web and so that the beam and secured barbell holders together form a barbell holder assembly; and seating a weightlifting barbell on the seating surfaces of the barbell holders of the assembly so that the barbell is adjacent the channel;

wherein the step of securing comprises the step of securing the barbell holders on the beam so that each barbell holder engages the upper flange.

11. The method of claim 10 wherein the step of securing comprises the step of securing the barbell holders on the beam so that each barbell holder engages the lower flange.

12. A method of securing a barbell comprising the steps of:

providing first and second barbell holders each having a securing mechanism and a body defining a seating surface;

securing with the securing mechanisms the barbell holders on a substantially horizontal metal beam so that the barbell holders are longitudinally spaced from one another and adjacent a channel defined between an upwardly extending web of the beam and upper and lower flanges of the beam which extend forward from the web and so that the beam and secured barbell holders together form a barbell holder assembly; and seating a weightlifting barbell on the seating surfaces of the barbell holders of the assembly so that the barbell is adjacent the channel;

wherein the step of securing comprises the step of rotating a first threaded member of each barbell holder which threadedly engages a respective second threaded member of each barbell holder so that a tip of each first threaded member securely engages one of the flanges.

13. A method of securing a barbell comprising the steps of:

providing first and second barbell holders each having a securing mechanism and a body defining a seating surface;

securing with the securing mechanisms the barbell holders on a substantially horizontal metal beam so that the barbell holders are longitudinally spaced from one another and adjacent a channel defined between an upwardly extending web of the beam and upper and lower flanges of the beam which extend forward from the web and so that the beam and secured barbell holders together form a barbell holder assembly; and seating a weightlifting barbell on the seating surfaces of the barbell holders of the assembly so that the barbell is adjacent the channel;

wherein the step of securing comprises the steps of rotating a first threaded member of each barbell holder which threadedly engages a second threaded member of each barbell holder respectively to move the first threaded member upwardly relative to the respective second threaded member, thereby vertically expanding the respective barbell holder; and rotating a third threaded member of each barbell holder which threadedly engages a fourth threaded member of each barbell holder respectively to move the third threaded member downwardly relative to the respective fourth threaded member, thereby vertically expanding the respective barbell holder.

14. A method of securing a barbell comprising the steps of:

providing first and second barbell holders each having a securing mechanism and a body defining a seating surface;

securing with the securing mechanisms the barbell holders on a substantially horizontal metal beam so that the barbell holders are longitudinally spaced from one another and adjacent a channel defined between an upwardly extending web of the beam and upper and lower flanges of the beam which extend forward from the web and so that the beam and secured barbell holders together form a barbell holder assembly; and seating a weightlifting barbell on the seating surfaces of the barbell holders of the assembly so that the barbell is adjacent the channel;

wherein the step of securing comprises the step of applying an upward force with each barbell holder on the upper flange.

15. The method of claim 14 wherein the step of securing comprises the step of applying a downward force with each barbell holder on the lower flange.

16. A method of securing a barbell comprising the steps of:

providing first and second barbell holders each having a securing mechanism and a body defining a seating surface;

securing with the securing mechanisms the barbell holders on a substantially horizontal metal beam so that the barbell holders are longitudinally spaced from one another and adjacent a channel defined between an upwardly extending web of the beam and upper and lower flanges of the beam which extend forward from the web and so that the beam and secured barbell holders together form a barbell holder assembly; and seating a weightlifting barbell on the seating surfaces of the barbell holders of the assembly so that the barbell is adjacent the channel;

wherein the lower flange has a bottom surface; and the step of securing comprises the step of securing the barbell holders on the beam so that no portion of the barbell holders extends lower than the bottom surface of the lower flange.

17. The method of claim 16 wherein the lower flange has an upper surface which bounds the channel; and the step of securing comprises the step of securing the barbell holders on the beam so that no portion of the barbell holders extends lower than the upper surface of the lower flange.

18. The method of claim 16 wherein the web has a front surface; and the step of securing comprises the step of securing the barbell holders on the beam so that no portion of the barbell holders extends rearwardly of the front surface of the web.

19. A method of securing a barbell comprising the steps of:

providing first and second barbell holders each having a securing mechanism and a body defining a seating surface;

securing with the securing mechanisms the barbell holders on a substantially horizontal metal beam so that the barbell holders are longitudinally spaced from one another and adjacent a channel defined between an upwardly extending web of the beam and upper and lower flanges of the beam which extend forward from the web and so that the beam and secured barbell holders together form a barbell holder assembly; and seating a weightlifting barbell on the seating surfaces of the barbell holders of the assembly so that the barbell is adjacent the channel;

wherein each of the barbell holders has a front and a back defining therebetween a horizontal depth; and the step of securing comprises the step of securing the barbell holders on the beam so that at least fifty percent of the horizontal depth of each barbell holder is within the channel.

20. The method of claim 19 wherein the step of securing comprises the step of securing the barbell holders on the beam so that each barbell holder is entirely within the channel.

* * * * *